United States Patent [19]

Hammett

[11] 4,356,789

[45] Nov. 2, 1982

[54] EMERGENCY EVACUATION SYSTEM FOR OFFSHORE OIL PLATFORM

[75] Inventor: Dillard S. Hammett, Dallas, Tex.

[73] Assignee: SEDCO, Inc., Dallas, Tex.

[21] Appl. No.: 88,760

[22] Filed: Oct. 29, 1979

[51] Int. Cl.[3] ..... B63B 23/00; B63B 27/00

[52] U.S. Cl. ..... 114/365; 114/264

[58] Field of Search ..... 9/3, 4 R, 4 A, 11 R, 9/8 P, 30, 31, 34, 35, 40, 46, 14; 114/322, 323, 264, 265; 169/62, 69; 182/141, 142, 150; 244/137 P, 138

[56] References Cited

U.S. PATENT DOCUMENTS

| | | | |
|---|---|---|---|
| 487,395 | 12/1892 | Mannheim | 182/142 |
| 1,112,221 | 9/1914 | Kowalsky | 9/4 |
| 1,136,938 | 4/1915 | Chupka | 9/46 |
| 1,363,036 | 12/1920 | Garcia | 9/30 |
| 1,754,213 | 4/1930 | Kelly | 9/30 |
| 3,828,858 | 8/1974 | Richter et al. | 244/137 P |
| 4,156,577 | 5/1979 | McMakin | 9/8 P |
| 4,232,625 | 11/1980 | Goren et al. | 114/264 |

*Primary Examiner*—Trygve M. Blix

*Assistant Examiner*—Jesús D. Sotelo

*Attorney, Agent, or Firm*—Hubbard, Thurman, Turner & Tucker

[57] ABSTRACT

A system and method for evacuating endangered personnel from an offshore oil platform. The disclosed system includes; a self-propelled marine service vessel equipped with a large capacity revolving crane, a portable evacuation shelter located on the platform and including a single point connecting eye for attaching a recovery line thereto, and a support for the shelter attached to the platform and engaging the shelter from beneath so as to permit the shelter to be lifted vertically from the platform. A rapid evacuation of personnel from the platform can be accomplished even in heavy seas with the disclosed system by maneuvering a marine service vessel into a position near the platform, loading the personnel to be evacuated into the shelter, attaching tension cables from the boom of the crane to the single point connecting eye, while substantially maintaining the service vessel in the standoff position and lifting the shelter from the platform and transporting it to a position of safety on the deck of the service vessel.

4 Claims, 5 Drawing Figures

EMERGENCY EVACUATION SYSTEM FOR OFFSHORE OIL PLATFORM

BACKGROUND OF THE INVENTION

This invention relates generally to a rescue device for use in marine operations and more particularly to a system and method for rapidly evacuating endangered personnel from an offshore oil platform. For the purposes of this disclosure, the term "oil platform" shall be understood to refer to any offshore structure used in connection with the exploration for or recovery of oil and/or natural gas.

As the growing worldwide demand for petroleum and petroleum products and the resultant rise in petroleum prices has increased, the trend has been to explore and drill in deeper and more dangerous waters. There has been much effort and investment made in the development of various tracts in the North Sea. In that area drilling has been conducted in the water varying in depth between three and six hundred feet and production platforms are currently under construction in water of such depths.

The North Sea is a relatively rough body of water. In certain areas, the mean wave height is six feet or greater about 35% of the time. As a result, marine operations are frequently interrupted due to heavy seas. Oil drilling and production in an environment of this sort inherently involves greater risk for workers on the platforms than they might be exposed to in calmer, warmer oceans. If the crew of an offshore oil platform is forced to evacuate the platform because of an actual or impending disaster, the members may be exposed to a very hostile ocean environment requiring special protection for survival. Most platforms are equipped with the conventional lifeboats and in some cases with rather sophisticated self-contained escape vessels which are completely enclosed and self-propelled. While conventional open life boats may provide a satisfactory means of escape in some situations, they may be inadequate much of the time in the North Sea. They are easily swamped or capsized in heavy seas and offer the crew little protection from exposure to such cold waters. The more sophisticated escape vessels offer greater protection but they also may become unmanageable in bad weather. Due to their greater complexity, the probability of their malfunctioning is inherently greater. Also, when the possibility of a fire arises, or a fire actually occurs on a platform, one of the first safety measures taken is to shut off all power on the platform. If it subsequently becomes necessary thereafter to evacuate the crew, power may not be available to activate or launch an escape vessel. Under such circumstances, it may even be unsafe to start the engine of an escape vessel in the immediate vicinity of the platform.

In some instances, helicopters have been successfully used to rescue endangered personnel from oil platforms. If the platform is actually on fire, however, it may not be safe to approach it with a helicopter. Also, the relatively small passenger carrying capacity of most rescue helicopters makes it impractical to use them to evacuate large crews which will man the giant platforms which are under construction or planned for the future.

Accordingly, it can be seen then that under many circumstances the various escape devices presently known and used in connection with oil platforms may be of little or no use to an endangered crew in an environment such as the North Sea.

Accordingly, it is an object of this invention to provide a system and method for safely evacuating personnel from an offshore oil platform in heavy seas.

It is a further object of this invention to provide an apparatus and method for quickly and safely evacuating relatively large crews from offshore platforms under weather conditions more severe than could be contended with by devices known in the prior art.

SUMMARY OF THE INVENTION

This invention can be most broadly summarized as an emergency evacuation system for an offshore oil platform which includes a portable evacuation shelter having a plurality of fire resistant walls cooperating to form a protective enclosure and having at least one entrance, means for providing ventilation, and a single point means centrally located above the center of gravity of the shelter for attaching a recovery line and a support for the shelter which is attached to the platform, engages the shelter from beneath and provides an unobstructed vertical clearance so as to permit the shelter to be vertically removed from the platform.

The system may also include a self-propelled, preferably semisubmersible, marine service vessel for transporting the shelter from the platform to a point of safety wherein the vessel includes a system for mantaining the vessel at a predetermined station with respect to the platform and a revolving crane mounted on the vessel for rotation about a vertical axis and having a main boom pivotally mounted for rotation about a horizontal axis.

The invention may be further summarized as a method for evacuating personnel from an offshore oil platform which includes the steps of loading the personnel into a portable evacuation shelter located on the oil platform, maneuvering a service vessel having a means for lifting mounted thereon into a position proximate the platform, attaching the lifting means to the shelter while substantially maintaining the position of the vessel with respect to the platform and transporting the shelter from the platform to the service vessel.

The present invention may also be summarized as a method for evacuating personnel from an offshore oil platform equipped with a lifeboat which is normally suspended from a lowering apparatus and has a single point means for attaching a recovery line and wherein the platform further includes a retractable support adapted to engage the undersurface of the lifeboat, said method including the steps of loading the personnel into the lifeboat, moving the support into an extended position, lowering the lifeboat into the support with the lowering apparatus, disengaging the lowering apparatus from the lifeboat, maneuvering a service vessel having a means for lifting mounted thereon into a position proximate the platform, attaching the lifting means to the shelter while substantially maintaining the position of the service vessel with respect to the platform, and transporting the shelter from the platform to the service vessel.

DESCRIPTION OF THE PREFERRED EMBODIMENTS

Figure 1:
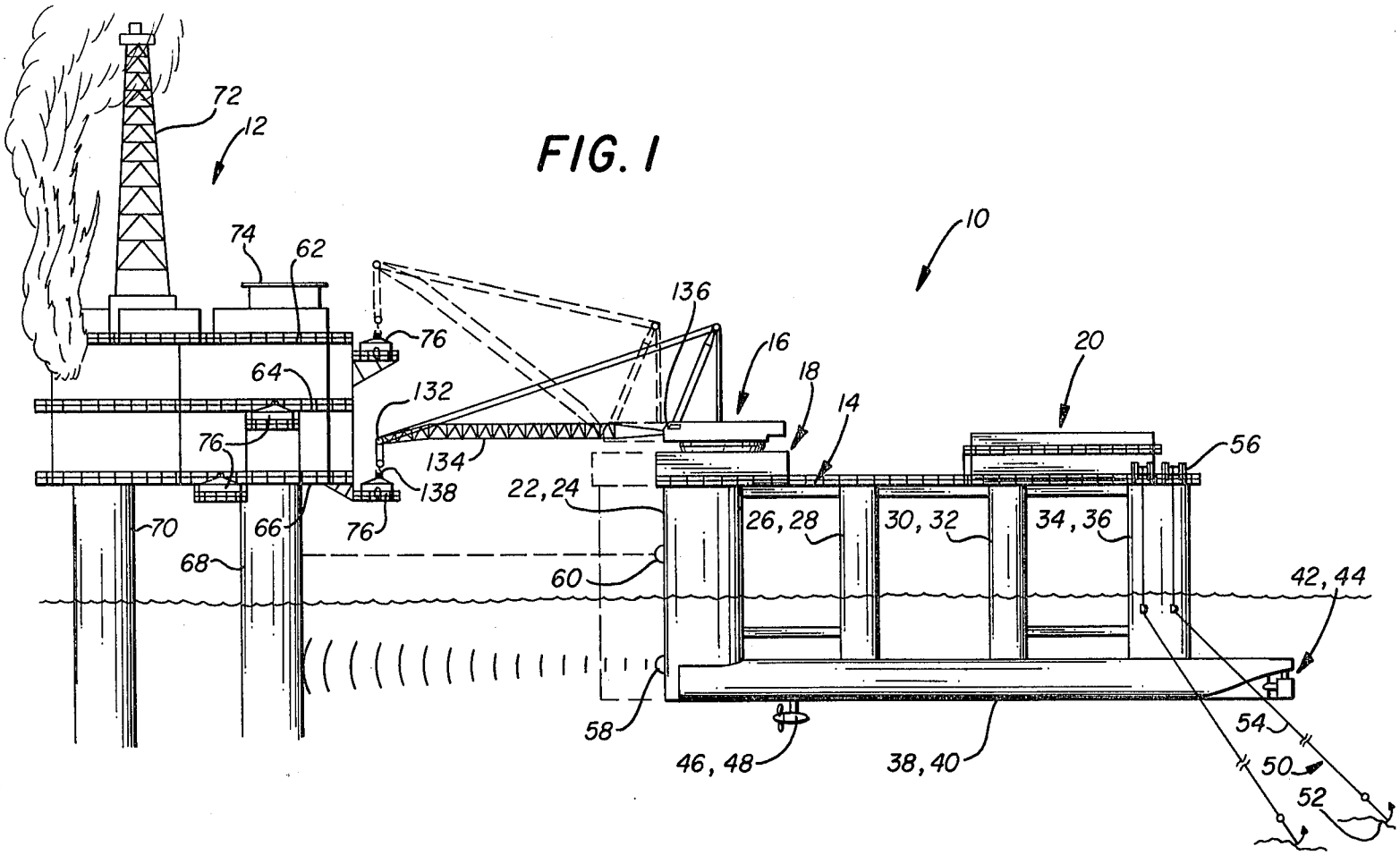
FIG. 1 is a side elevation of the present invention in one operating position during a rescue operation with a second operating position illustrated in phantom.

In FIG. 1, one embodiment of the present invention is illustrated in operation. In that view, marine service vessel 10 is shown anchored in a standoff position from oil production platform 12 upon which a fire is burning. Vessel 10 is preferably of the type generally known in the art as a semi-submersible and may be more particularly described as a self-propelled column stabilized semi-submersible service vessel. If this invention is to be used in areas where the seas are relatively calm, a conventional vessel such as a barge might be used. But such barges can normally not be operated when the seas are higher than six feet. Accordingly, since this invention is intended for use in rough waters such as the North Sea, a more versatile vessel such as a semi-submersible is preferable.

Vessel 10 can achieve speeds up to 10 knots in calm water and has sufficient fuel capacity to travel up to 10 days at maximum speed. In heavy seas, the vessel exhibits a stability which is characteristic of column stabilized semi-submersibles. When operating in a draft of 60 feet in 30 foot waves, the vessel's vertical motion or heave will be only about 3 feet and its pitch and roll only about two degrees. The vessel's normal operating draft is 60 feet but it can propel itself through waters as shallow as 21 feet.

The primary structure of the vessel includes a generally rectangular main deck 14 which measures 400 feet long by 200 feet wide. The deck supports a 350 ton capacity revolving crane 16 of generally conventional design which is mounted on base 18 for rotation about an axis which is vertical, or normal to deck 14. Also located on the deck is aft deck house 20, a two story structure which includes living quarters, shops, control and engine rooms. The deck is supported by two forward stability columns 22 and 24, four intermediate stability columns 26, 28, 30 and 32, and two aft stability columns 34 and 36. In this view, only columns 22, 26, 30 and 34 are visible. The four visible stability columns are joined at their lower end to a generally cylindrical, slender elongated lower hull 38. Similarly, the four remaining columns 24, 28, 32 and 36 are joined at their lower ends to lower hull 40, not visible in this view, which is oriented parallel to lower hull 38 and spaced apart from it a distance of approximately 195 feet, center to center. The length of each lower hull is approximately 450 feet and the distance from the bottom of the lower hulls to the main deck is approximately 160 feet. Additional support and stability for the structure is provided by a plurality of truss members, not shown in this view, some of which interconnect opposing pairs of stability columns such as 22 and 24 and some of which interconnect the upper deck and the stability columns.

Buoyancy for the vessel is provided by the eight stability columns and the two lower hulls. The columns may contain combinations of buoyant void tanks, ballast tanks and equipment storage areas. One forward stability column also includes a fire pump room. The lower hulls contain pump room compartments, ballasting tanks, and a series of tanks for storing fuel oil and fresh water.

Propulsion for the vessel is provided by port and starboard propulsion units 42 and 44 which are located at the aft end of lower hulls 38 and 40, respectively. Each units includes a conventional propeller enclosed within a kort nozzle and driven by an engine located in the aft end of its associated lower hull. Directional control of the vessel is provided by a pair of azimuthing thruster assemblies 46 and 48 which are located near the forward ends of lower hulls 38 and 40, respectively.

The vessel employed in this invention must also be capable of maintaining a position (referred to as a "standoff position") with respect to an offshore oil platform during operation. While in some situations, a simple anchoring system might be sufficient, the preferred vessel employs a combination of an anchoring system, the propulsion and thruster motors previously mentioned, and two independent ranging systems to ensure relatively accurate station keeping, even in heavy seas. The anchoring system consists of 8 anchor assemblies of which anchor assembly 50 is typical. Anchor assembly 50 includes a 30,000 danforth-type anchor 52 which is secured to 3 inch diameter wire mooring line 54. The mooring line is controlled by a double drum winch 56 which is capable of holding 4,700 feet of mooring line. Each winch may be controlled either from an associated control panel housed in a nearby protective enclosure or from a remote control console located in deck house 20.

Normally, when the vessel is engaged in a rescue operation, it will be positioned upwind of platform 12. Under such circumstances, the wind and sea will tend to move the vessel toward the platform so rear anchors will be deployed from the rear of the vessel to limit its movement in that direction. If time permits, other anchors will be deployed on either side of the vessel to further stabilize its position. If a direct upwind approach is not possible, thrusters and propulsion units may be employed independently or in combination to assist in maintaining the desired position of the vessel and proper tension on the mooring lines.

During a rescue operation, it is necessary that the distance between the vessel and the platform be continuously monitored and maintained with relative accuracy. For this purpose, the preferred embodiment includes two independent measuring means, a sonar system 58 and a laser ranging system 60. The sonar system is used to determine the range to underwater objects and is sensitive enough to detect a 6 inch pipe at a range of 1000 feet and to indicate that range to an accurancy of within one foot. The laser system 60, used to indicate the distance between vessel 10 and objects above the water, is capable of indicating the range of an object 500 feet away to an accuracy of one inch. Both systems are used to monitor continuously and will trigger an alarm if the range of the detected object is less than a preselected minimum.

Figure 2:
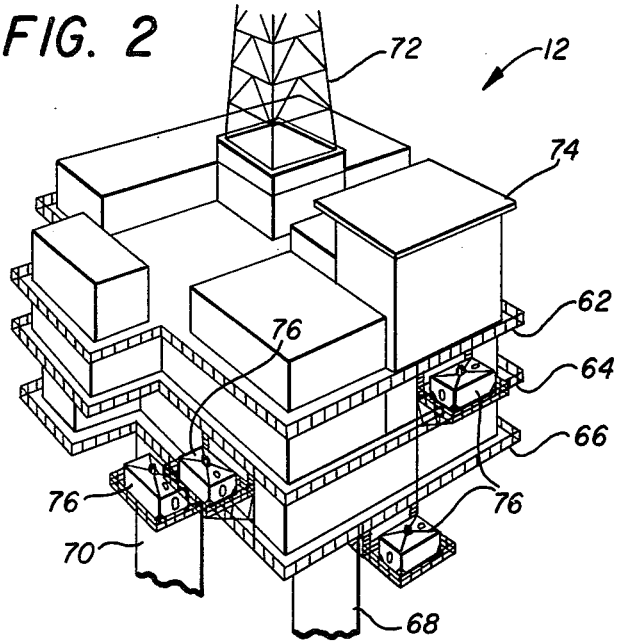
FIG. 2 is a perspective view of a multilevel oil production platform having a plurality of evacuation shelters.

FIG. 2 shows a perspective view of the offshore oil platform of FIG. 1. The platform is typical of certain large multilevel production platforms which are presently under construction or planned for use in the North Sea except that it has been modified according to the teachings of the present invention. The platform has three levels, 62, 64 and 66, and is supported by three large concrete columns, 68, 70 and 72 (not shown) which extend to the seabed. The distance from the water to the top of the drilling derrick 72 is approximately 350 feet. A plurality of wells are drilled through each of columns 70 and 72, and the associated wellheads are grouped in one of two wellhead rooms located above the respective columns just below level 62. Crew living quarters 74, which can house up to 200 persons, are located on upper deck 62 away from the vicinity of the wellhead rooms and associated fire hazards.

A plurality of evacuation shelters 76 are disposed about the platform in various locations where they would be easily accessible to platform crew members in the event of an emergency. Also, they are generally remote from the location of the wellhead rooms. A typical evacuation shelter is shown in greater detail in FIGS. 3 and 4. The shelter is generally rectangular in shape and includes two sidewalls 78, two end walls 80, a floor 82 and the roof assembly 84. The walls, roof, and floor are preferably but not necessarily of double wall construction and filled with a suitable insulation material 86. End walls 80 each contain an entrance 88, and roof assembly 84 contains an emergency escape hatch 90. Ventilation for occupants of the shelter is provided by vents 92 and 94 which can be sealed from the inside by the occupants. Benches 100 and 102 provide seating space for approximately 40 occupants, although the shelter may accomodate substantially more. In addition to the features described, it should be obvious that a variety of additional accomodations such as passenger restraining devices and handrails can be added to the interior of the shelter if desired.

In order that the shelter can be lifted from the platform by crane 16 or some other sort of lifting device, double eye 104 is provided in a central location on roof 84 approximately above the center gravity of the shelter. The eye is placed in that location so that the shelter will tend to remain relatively level when it is lifted from the platform, assuming that the weight of the occupants is distributed in a reasonably uniform manner within the shelter. In order that it can withstand the loads likely to be imposed upon it when lifted from the platform, the structure is reinforced by well known means.

Figure 3:
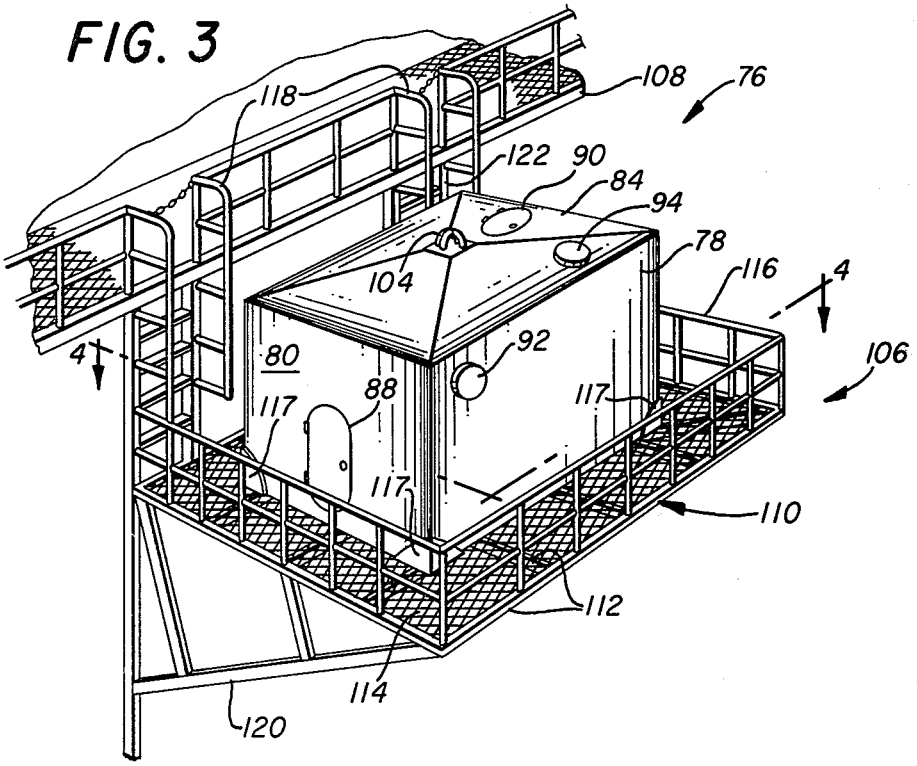
FIG. 3 is a perspective view of a typical evacuation shelter of FIG. 2 with its associated support.
Figure 4:
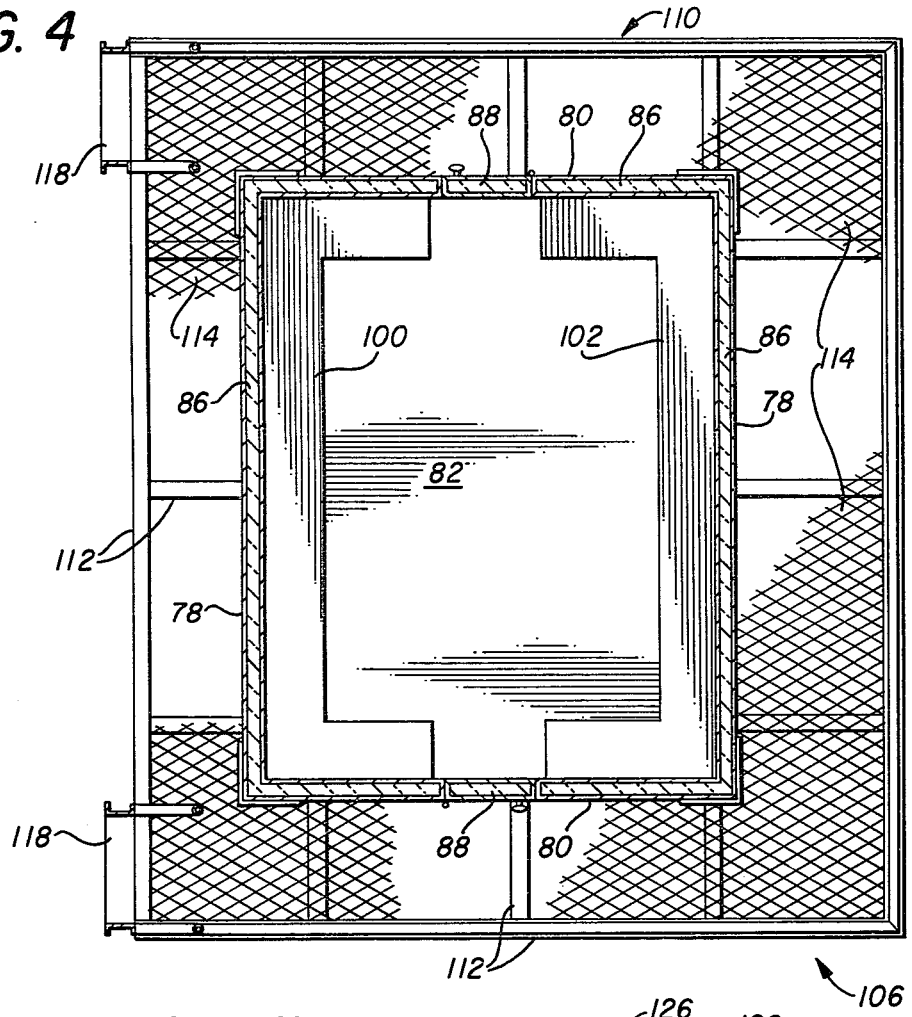
FIG. 4 is a sectional view of the shelter and support of FIG. 3 taken at position 4—4.

As shown in FIG. 3, shelter 76 normally rests on support structure 106 which is located below and extends in an outboard direction beyond associated platform level 108. The structure includes a base 110 which has a steel framework 112 and a walking surface 114 made of a heavy metal grid.

Base 110 is connected to platform 12 by truss framework 120 which has a pair of vertical members 122 extending between level 108 to the level immediately below. Obviously, a variety of supporting means can be satisfactorily substituted for this arrangement. For example, it might be desirable to cantilever support 106 from the platform by extending a plurality of horizontal beams from the platform to various points underneath base 110. It is unnecessary in most applications to secure the shelter to base 110, but preferably means should be provided to prevent it from sliding horizontally on the base. For this purpose, four corner brackets 117 are attached to framework 112 as shown.

Support 106 has been positioned outboard of the platform itself to ensure unobstructed vertical clearance above the shelter. This clearance is necessary, of course, so that the crane 16 or other lifting means employed to lift the shelter from the platform will have free access to double eye 104 and so that the shelter can be lifted vertically from the platform without striking any part of it. In estimating the necessary clearances, it should be anticipated that the shelter may rotate or swing slightly while being lifted. Also, platform 106 is preferably located below the level of deck 108 as shown in order to provide the shelter and its occupants with some degree of protection from fire and explosions occurring on or above level 108.

Protection for crew members entering the shelter is provided by handrail 116 which extends around the outer periphery of the walking surface. Access to the shelter from platform level 108 is provided by either one of two ladders 118.

Figure 5:
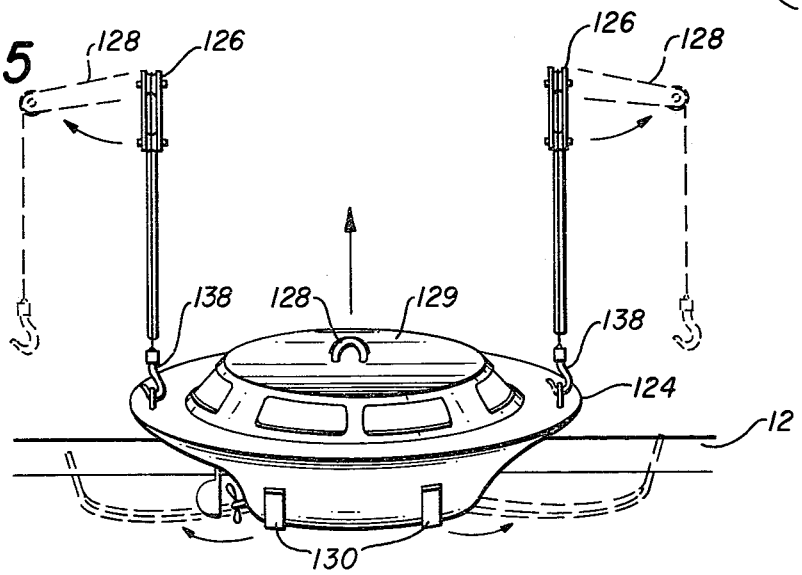
FIG. 5 is a perspective view of a typical enclosed, self-propelled lifeboat including a modified lowering system and a retractable support system attached to a typical oil platform.

FIG. 5 illustrates a completely enclosed, self-contained escape vessel 124 and its associated lowering system 126 attached to offshore oil platform 12. The escape vessel and the lowering system are similar in most respects to those presently known in the art except they have been modified according to the teachings of the present invention. Vessel 128 now includes single point attachment means 128, preferably a double eye similar to double eye 104 centrally located on the roof of cabin 129. Lowering means 126 has been modified to permit arms 128 to be pivoted 90° in opposite directions as shown, and a pair of support arms 130 adapted to engage the underside of vessel 124 are mounted to platform 12. The arms are pivotally mounted to the platform by obvious means permitting them to be moved from extended positions underneath the vessel to the retracted positions shown in phantom. Preferably, means should be provided for locking the arms in the extended positions.

When an emergency call is received from an offshore oil platform and it is determined that personnel on the platform should be evacuated for their safety, service vessel 10 will proceed to the vicinity of the endangered platform. Ordinarily, the platform will be approached from the upwind side to give the service vessel and its crew maximum protection from a fire on the platform. When the vessel nears the platform, rear anchors 52 will be deployed to control the final approach to a standoff position. Sonar system 58 and laser ranging system 60 will be employed to accurately indicate the range between underwater and above water portions of the platform and the service vessel. The vessel will then be carefully maneuvered into a preselected final standoff position from which the outer end 132 of crane boom 134 can be positioned vertically above double eye 104.

With the vessel being held in the selected standoff position the crane operator, located in cab 136, will engage eye 104 with hook 138 as shown in FIG. 1. When the hook is secured, the shelter can be lifted free of the support and platform. Then the crane can be rotated approximately at 180° and the shelter lowered to a position of safety on the deck of the service vessel.

In the event the platform is equipped with the modified escape vessel system shown in FIG. 5, personnel can be evacuated by one or two methods. If the sea is not too rough for the use of a lifeboat and it is functioning properly, it can be loaded and launched in the conventional fashion. If the sea is too rough or if some mechanical problem prevents a conventional launching of the vessel, it can be lifted from the platform by the service vessel crane and placed on the deck of the service vessel much in the same way that the shelter is.

If the latter method is to be used, arms 130 must first be moved into their extended positions and locked in place. Next, escape vessel 124 is lowered slightly with lowering means 126 until it rests on supports 130. Finally, hooks 138 are disengaged from the vessel and the lowering means are rotated into the positions shown in phantom in FIG. 5. When personnel are loaded into the vessel, it can then be lifted from arms 130 and transported by the crane into a position of safety on the service vessel in the same manner as the shelter.

Thus, it can be seen that this invention provides for a system and method for evacuating endangered personnel from an offshore oil platform in heavy seas. Although only certain specific embodiments of this invention have been illustrated and described, it is to be understood that obvious modifications may be made of them without departing from the true spirit and scope of this invention.

What is claimed is:

1. A method for evacuating personnel from an offshore oil platform, said platform including a portable evacuation shelter, comprising the steps of:

loading said personnel into said shelter;

maneuvering a service vessel having means for lifting mounted thereon into a position proximate said platform, said service vessel including position indicating means for determining the position of said service vessel from submerged and above surface portions of said platform;

monitoring said position indicating means and maintaining said service vessel a predetermined distance from said submerged and above surface portions of said platform and without connecting said service vessel to said platform;

attaching said means for lifting to said shelter while substantially maintaining the position of the service vessel with respect to said platform;

lifting said shelter substantially vertically from said platform; and transporting said shelter from said platform to said service vessel.

2. The method of claim 1 wherein said means for lifting is a revolving crane.

3. A method for evacuating personnel from an offshore oil platform, said platform including a lifeboat equipped with a single point means for attaching a recovery line and suspended from a lowering apparatus, and further including a retractable support adapted to engage an undersurface of said lifeboat, comprising the steps of:

loading personnel into said lifeboat;

moving said support into an extended position;

lowering said lifeboat onto said support;

disengaging said lowering apparatus from said lifeboat;

maneuvering a service vessel having means for lifting mounted thereon into a position proximate said platform;

maintaining a predetermined distance from said platform and without connecting said service vessel to said platform;

attaching said means for lifting to said lifeboat while substantially maintaining the position of the service vessel with respect to said platform;

lifting said lifeboat substantially vertically from said platform; and transporting said lifeboat from said platform to said service vessel.

4. An emergency evacuation system for an offshore oil platform, comprising:

a portable evacuation shelter having a plurality of fire resistant walls cooperating to form a protective enclosure, said enclosure having at least one entrance, means for providing ventilation, and single point means for attaching a recovery line centrally located above the center of gravity of said shelter;

means attached outboard of at least one side of said platform for supporting said shelter, said support means engaging said shelter from beneath and providing unobstructed vertical clearance so permitting said shelter to be vertically removed from said oil platform;

means for transporting said shelter from said platform to a point of safety comprising a vessel, said vessel including:

a system for maintaining said vessel at a predetermined station with respect to said platform standing off from said platform and without being connected to said platform;

said system for maintaining said vessel including means for indicating the position of said vessel with respect to submerged and above surface portions of said platform; and a revolving crane mounted on said vessel for rotation about a vertical axis, said crane including a base and a main boom pivotally mounted for rotation about a horizontal axis for positioning said boom to extend above said shelter for lifting said shelter substantially vertically from said supporting means and placing said shelter on said vessel.

* * * * *